United States Patent [19]

Beloff

[11] Patent Number: 4,777,968

[45] Date of Patent: Oct. 18, 1988

[54] DEVICE FOR EXTINGUISHING CIGARS

[75] Inventor: Arthur L. Beloff, Milford, Conn.

[73] Assignee: Cigar Savor, Inc., Hamden, Conn.

[21] Appl. No.: 42,050

[22] Filed: Apr. 24, 1987

[51] Int. Cl.[4] ..... A24F 15/08; A24F 15/18

[52] U.S. Cl. ..... 131/256; 131/241; 131/329

[58] Field of Search ..... 131/256; 401/273, 243, 401/127

[56] References Cited

U.S. PATENT DOCUMENTS

| | | | |
|---|---|---|---|
| 1,138,772 | 5/1915 | Matthews | 401/273 |
| 1,204,053 | 11/1916 | Moore | 401/243 |
| 2,514,876 | 7/1950 | Kost | 131/256 |
| 2,575,261 | 11/1951 | La Torre | 131/256 |
| 2,715,961 | 8/1955 | Field | 131/256 |
| 4,168,129 | 9/1979 | Herrnring | 401/243 |
| 4,660,575 | 4/1987 | Andreason | 131/256 |

FOREIGN PATENT DOCUMENTS

| | | | |
|---|---|---|---|
| 0212485 | 11/1940 | Switzerland | 131/256 |
| 0447501 | 3/1968 | Switzerland | 401/127 |

*Primary Examiner*—Vincent Millin

*Attorney, Agent, or Firm*—Bachman & LaPointe

[57] ABSTRACT

The present invention relates to an improved device for rapidly extinguishing and preserving lighted cigars. The device comprises a hollow cylindrical tube having a closed end and an open end, an end cap for sealing the open end so as to form a substantially airtight container, and a snuffer positioned within the tube and adapted for movement relative to the tube. The device further includes a spring for restoring the snuffer to a desired initial position and a clip for permitting the device to be retained within the pocket of a user.

12 Claims, 1 Drawing Sheet

DEVICE FOR EXTINGUISHING CIGARS

The present invention relates to a device for rapidly extinguishing a lighted cigar and preserving it.

Cigar smokers, because of the length of time required to smoke an entire cigar, often need to extinguish the cigar before it is completely consumed. As more and more public facilities become designated non-smoking sites, this problem will become even more pronounced. Devices for extinguishing lighted smoking materials and/or saving them are known in the art. For example, U.S. Pat. No. 1,764,862 to Vogelsang illustrates a portable cigar or cigarette extinguisher comprising a hollow member having a cylindrical bore for receiving the cigar. The hollow member may be furnished with a fixed or detachable base so that when placed on a flat surface it is closed in a airtight manner. The base may also be used as a receptacle for ashes. A second base may be provided if desired to be used as a lid or a cover.

U.S. Pat. No. 3,173,641 to Dorrance illustrates an ash tray and snuffer device. The Dorrance device comprises a hollow receptacle open at one end and closed at the other mounted to a base by a wire support structure. While this device is portable, one could not easily put it into the pocket of one's clothing. Further, there is no means to prevent tobacco juices from coming into contact with and staining the user's clothing.

U.S. Pat. No. 302,300 to Maclachlan illustrates another cigar extinguisher and retention device. The Maclachlan device comprises a hollow, conical cap and an elastic tube for covering the extinguished cigar. When it is desired to extinguish a lighted cigar using the Maclachlan device, one inserts the burning end into the cap and unrolls the elastic tube over the cigar. Hereagain though, the wetted end of the cigar remains exposed. U.S. Pat. No. 450,312 to Hieatzman illustrates a closed case for extinguishing and preserving a cigar. The Hieatzman device comprises a base portion having a blade type device for cutting off the burning portion of the lighted cigar. The base portion has a hollow portion for receiving the cigar. The device further includes a telescopic portion which fits into the hollow portion to form a sealed container. One problem associated with this device is the possibility of damaging the cigar while it is being preserved. The telescoping feature of Hieatzman can lead to cigar damage if the second portion is inadvertently forced toward or against the base portion.

Another type of cigar holder is illustrated in U.S. Pat. No. 3,978,981 to Musick. This device differs from the other devices in that it is not intended to be used as a cigar extinguisher. The Musick device comprises a receptacle for receiving the lighted end of the cigar and a separate cap for receiving the wet end of the cigar. The receptacle has a mesh venting screen to permit the cigar to burn. As a result, this type of device could not easily be carried in a pocket of a user. As the cigar continues to burn and give off smoke, the user could inhale the smoke. Further, the user's clothing will become permeated with the smoke odor.

The present invention relates to an improved device for rapidly extinguishing and preserving a lighted cigar. The device comprises a hollow cylindrical tube having a closed end and an open end opposed to said closed end; means for sealing the open end of the tube so as to form a substantially airtight container; and means for snuffing the lighted cigar positioned within the tube. The snuffing means is adapted for movement relative to the tube so as to accommodate cigars of different lengths within the device. The device further includes a spring means for restoring the snuffing means to a desired position and a clip for permitting retention of the device in a user's pocket. By forming the device from non-combustible, high impact, high melting point materials, a cigar may be preserved for subsequent use in a safe and convenient manner.

It is an object of this invention to provide a device for extinguishing and preserving a cigar.

It is a further object of the present invention to provide a device as above which will accommodate cigars of different lengths and dimensions.

It is a further object of the present invention to provide a device as above which may be carried within the pocket of the user's apparel.

These and further objects and advantages will become more apparent from the following description and drawings in which like reference numerals depict like elements.

Figure 1:
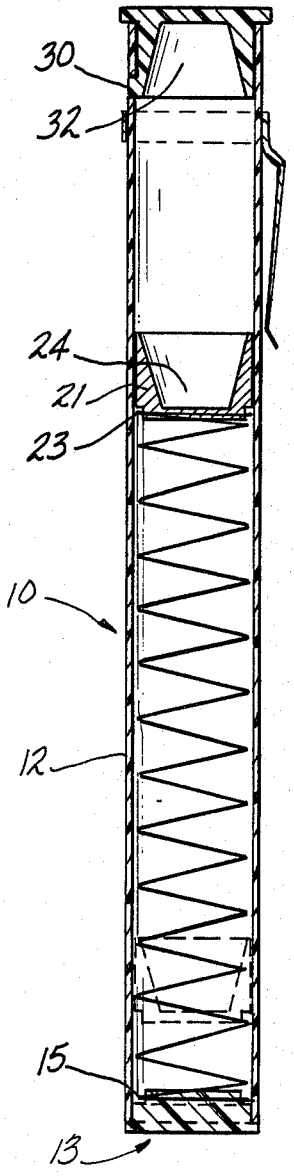
FIG. 1 is a cross sectional view of the cigar extinguishing and preserving device of the present invention.
Figure 2:
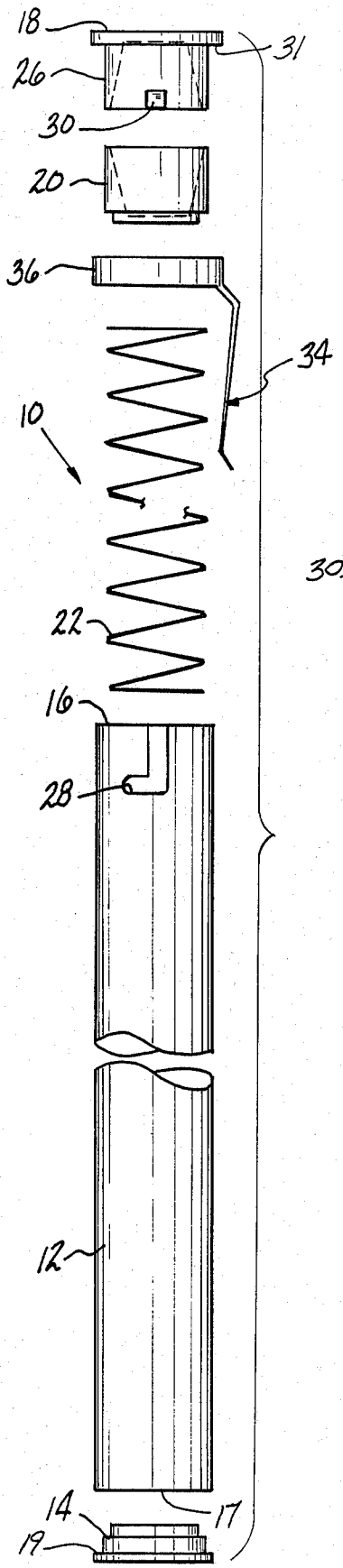
FIG. 2 is an exploded view showing the various components of the device of FIG. 1.

As previously discussed, the device of the present invention is designed to rapidly extinguish a lighted cigar and preserve it for later use. The device is further designed to be carried by the user and to prevent the transfer of undesirable tobacco juices and smoke odors to the user's apparel. In addition, the device is designed to accommodate cigars of different lengths and diameters.

Referring now to the figures, the device 10 comprises a hollow cylindrical tube 12 having a closed end 13 and an open end 16. The tube 12 may have any desired length and any desired inner and outer diameters. Preferably, the tube is of a size sufficient to permit the accommodation of cigars of different lengths and diameters.

The tube 12 is formed from a material which is highly resistant to impact in order to fully protect the cigar. In view of the fact that the device will initially contain a lighted cigar, the tube material should also be non-combustible and have a relatively high melting point. Suitable materials for the tube include but are not limited to plastics such as polypropylene, polyethylene, polycarbonate and nylon. If desired, the tube 12 could be formed from a metal or metal alloy which does not transmit significant amounts of heat to the user.

The closed end 13 of the tube 12 is formed by a substantially cylindrical, solid end cap 14 inserted within an opening 17 in the tube. The end cap 14 has incorporated therein a lip portion 19 which abuts against the end wall of the tube 12. The lip portion 19 insures proper positioning of the cap 14 relative to the tube 12 and helps form a good seal. Once properly seated, the end cap 14 is fixedly secured to the tube 12 as by an adhesive. The end cap 14 is preferably formed from the same material as the tube 12.

The device 10 further includes a substantially cylindrical, removable end cap 18 for sealing the open end 16 of the tube and thereby providing a substantially airtight container. The cap 18 is designed to fit within the open end of the tube and comprises a cylindrically shaped member 26 having a bore 32, preferably in the shape of a truncated cone, for receiving an end portion of the cigar. The cap 18 also has an integrally formed lip 31 for abutting against an end wall of the tube and thereby forming a good seal with the tube.

Figure 3:
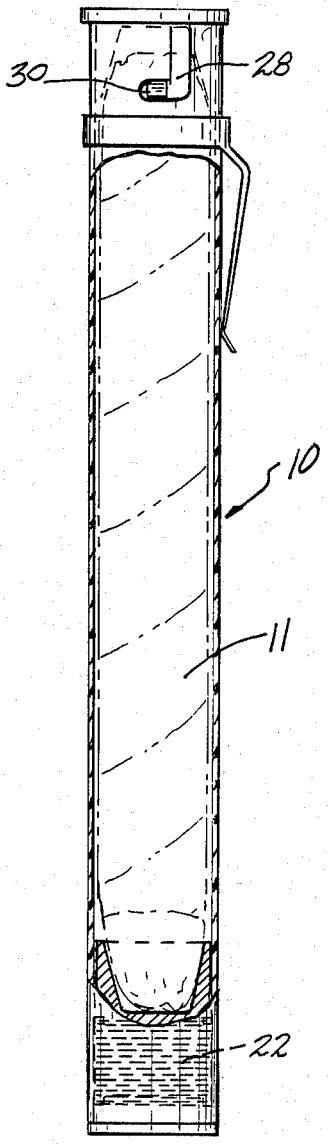
FIG. 3 is a view in partial cross section illustrating a cigar housed within the device of the present invention.

The device 10 is further characterized by means for locking the cap 18 to the tube 12. The locking means comprises an L-shaped slot 28 in the tube 12 and a flange 30 preferably formed as an integral part of the cap 18. To lock the cap 18 in place, the flange 30 is inserted into the slot 28 and the cap is rotated until the flange is in the position shown in FIG. 3.

The cap 18 and the flange 20 may be formed from any suitable material known in the art. Preferably, they are formed from the same material as tube 12 and end cap 14.

A snuffer 20 is provided within the tube 12 for extinguishing the cigar 11. The snuffer 20 preferably comprises a cylindrical member 21 having a bore 24 for receiving the lighted end of the cigar. Preferably, the bore 24 is in the shape of a truncated cone. The snuffer 20 is sized to permit relative sliding movement between it and the tube. By providing such an arrangement cigars of different lengths can be accommodated. A spring 22 such as a helical spring is provided within the tube 12 to restore the snuffer 20 to a desired initial position. The spring 22 is preferably connected or locked to both the end cap 14 and the snuffer 20. Grooves 15 and 23 may be provided in the end cap 14 and the snuffer 20 respectively for locking the spring 22 in place.

While the snuffer 20 may be formed from any desired material, it is preferably formed from a thermally conductive metal such as aluminum or a metal alloy. The use of a metallic snuffer is desireable for permitting heat from the lighted end of the cigar to be dissipated.

To permit the device to be worn in a pocket of the user's apparel, a clip 34 is provided. The clip 34 may comprise any suitable clip device known in the art. For example, the clip 34 may have a portion for overlapping the user's pocket and an integral ring element 36 for sliding over and engaging the outer periphery of the tube 12. Alternatively, the clip could be an integral part of the tube 12.

The device 10 is used by inserting the lighted end of a cigar 11 into the tube 12 until it contacts the bottom of the bore 24 in the snuffer 20. The cigar is then pushed by the user towards the closed end 13 of the tube. This causes the snuffer 20 to move towards the closed end 13 and the spring 22 to become compressed. The cap 18 is then placed over the wetted end of the cigar and inserted into the open end of the tube 12 until the flange 30 hits the bottom of the slot 28. The cap 18 is then rotated until the flange 30 is in its locked position. Since the cap 18 forms a substantially airtight container with the tube 12, the cigar will be rapidly extinguished. When the user wishes to smoke the cigar again, the cap 18 is rotated until the flange 30 is in its unlocked position. The cap 18 is then removed from the tube 12. The spring 22 will cause the cigar 11 to extend outwardly of the tube 12 and will ultimately restore the snuffer 20 to its initial position.

While the end cap 14 is preferably fixedly secured to the tube 12, it could also be removable. A removable end cap would be useful if the spring 22 has to be serviced or replaced for any reason.

In lieu of the end cap 14, the tube 12 if desired could be formed with an integral closed end portion.

The U.S. patents discussed in the above specification are intended to be incorporated by reference herein.

It is apparent that there has been provided in accordance with this invention a device for extinguishing cigars which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variation as fall within the spirit and broad scope of the appended claims.

What is claimed is:

1. A device for rapidly extinguishing a lighted cigar comprising:

a hollow cylindrical tube having a closed end portion and an open end opposed to said closed end portion;

a cap adapted to fit within said open end of said tube for sealing said open end so as to form a substantially airtight container with said tube and thereby promote rapid extinguishment of said lighted cigar;

said cap having a bore shaped to receive an unlit, wetted end of said cigar and a flange adapted to engage a substantially L-shaped slot in said tube so as to positively lock said cap to said tube in a way which insures the formation of said substantially airtight container;

means for snuffing said lighted cigar positioned within said tube; and said snuffing means being adapted to move relative to said tube to accommodate cigars of different lengths.

2. The device of claim 1 further comprising:

means for restoring said snuffing means to a desired position.

3. The device of claim 2 wherein said restoring means comprises a spring connected to said closed end portion and said snuffing means.

4. The device of claim 3 wherein said spring comprises a helical spring.

5. The device of claim 1 further comprising:

said snuffing means being formed by a substantially cylindrically shaped member having a bore for receiving the lighted end of said cigar.

6. The device of claim 1 wherein said closed end portion is formed by an end cap secured to said tube.

7. The device of claim 6 further comprising:

said tube, said end cap, said cap adapted to fit within said open end and said snuffer means each being formed from a non-combustible, high impact, and high melting point material.

8. The device of claim 7 further comprising:

said tube, said end cap, and said cap adapted to fit within said open end each being formed from a plastic material; and said snuffing means being formed from a metal or metal alloy.

9. The device of claim 8 wherein said tube, said end cap, and said cap adapted to fit within said open end are each formed from nylon and said snuffer means is formed from aluminum.

10. The device of claim 9 wherein said clip means comprises a clip having an integral ring portion.

11. The device of claim 1 further comprising:

means for permitting said device to be clipped to a user's apparel.

12. The device of claim 1 wherein said closed end portion is formed by a removable end cap inserted within said tube.

* * * * *